US009387531B1

(12) United States Patent
Liu

(10) Patent No.: US 9,387,531 B1
(45) Date of Patent: Jul. 12, 2016

(54) RIVETING DEVICE

(71) Applicant: Pao-Fang Liu, Miao li Hsien (TW)

(72) Inventor: Pao-Fang Liu, Miao li Hsien (TW)

( * ) Notice: Subject to any disclaimer, the term of this patent is extended or adjusted under 35 U.S.C. 154(b) by 0 days.

(21) Appl. No.: 14/686,178

(22) Filed: Apr. 14, 2015

(51) Int. Cl.
*B21J 15/38* (2006.01)
*B21J 15/36* (2006.01)
*B25B 27/00* (2006.01)

(52) U.S. Cl.
CPC ..... *B21J 15/36* (2013.01); *B21J 15/386* (2013.01); *B25B 27/0007* (2013.01)

(58) Field of Classification Search
CPC ..... B21J 15/36; B21J 15/386; B25B 27/0007
USPC ..... 29/243.527
See application file for complete search history.

(56) References Cited

U.S. PATENT DOCUMENTS 4,653,308 A * 3/1987 Gregory ..... B21J 15/043 29/243.5
9,003,621 B2 * 4/2015 Ko ..... B21J 15/386 29/243.521
2014/0345099 A1 * 11/2014 Ko ..... B21J 15/383 29/243.527

* cited by examiner

*Primary Examiner* — David B Jones
(74) *Attorney, Agent, or Firm* — Muncy, Geissler, Olds & Lowe, P.C.

(57) ABSTRACT

A riveting device comprises an inner guide sleeve having a push rod thereinside; an outer guide sleeve sleeving the inner guide sleeve; a hold ring disposed inside and tightly pressed against the outer guide sleeve; and a driver. The screw body of a screw is inserted through the outer guide sleeve and hold ring and screwed into a river nut. The screw head is disposed inside the inner guide sleeve and tightly pressed against the hold ring by the push rod. The driver is combined with the inner guide sleeve and drives the inner guide sleeve, push rod, outer guide sleeve, hold ring, screw and rivet nut to move jointly and rivet the rivet nut. The present invention is characterized in using the push rod, hold ring and outer guide sleeve to secure the screw and exemption from the limitation by the size or shape of the screw head.

12 Claims, 5 Drawing Sheets

RIVETING DEVICE

BACKGROUND OF THE INVENTION

1. Field of the Invention

The present invention relates to a riveting device, particularly to a riveting device adaptive to any screw head.

2. Description of the Related Art

The current riveting devices must cooperate with a mandrel. The rivet nut is rotated clockwise and locked to the mandrel. Then, the user pulls the mandrel backward with force to fasten the rivet nut. After riveting is completed, the rivet nut is fastened to the workpiece. Then, the user rotates the mandrel counterclockwise to separate the mandrel from the rivet. All the riveting devices available in the market use dedicated mandrels. In other words, each manufacturer has its own mandrel design. The mandrel must match the thread specification of the rivet nut. Sometimes, the mandrel of the riveting device does not match the rivet nut available for the user. For example, the riveting device adopts a metric system mandrel but the rivet nut has an inch screw thread. If the mandrel fractures, the user has to find the same mandrel manufactured by the original manufacturer. However, the local importers do not necessarily import the required products.

The manufacturers are also troubled by the same problem that the mandrel must match the rivet nut. There are many specifications of threads. The mandrel has to match the rivet nut in the thread specification.

Thus, the amount of manufacture and stock become a problem. Some thread specifications are very rare. Maybe, less than 50 pieces of rare-specification mandrels are sold within 10 years. However, the rare-specification mandrels must be mass-produced. Sometimes, the user directly contacts the manufacture to enquire a mandrel, which involves transport charge and remittance charge and is neither convenient nor economical for both parties. There are pneumatic riveting devices using ready screws as mandrels in the market. However, these pneumatic riveting devices only adopt hexagon socket head cap screws as mandrels. Refer to FIG. 1. The size of the guide sleeve 10 varies with the diameter of the screw 12. The fastening element 14 is an indispensable element that enables the screw 12 to rotate synchronously with the components inside the riveting device. In a manual riveting device, one end of the mandrel must be fastened to a component inside the riveting device. The user rotates the component so as to rotate the mandrel clockwise and counterclockwise. In other words, the mandrel and the component must rotate synchronously. In application, the user screws the rivet nut to the mandrel before riveting and then rotates the mandrel to separate (unscrew) the mandrel from the rivet after riveting. The pneumatic riveting device operates in the same principle except the component is driven by a pneumatic motor. In order to prevent the screw 12 from rotating independently, the current design adopts the abovementioned fastening element 14 to overcome the problem. However, such a design has other problems: firstly, the user can only use a hexagon socket head cap screw as the mandrel; secondly, the hexagon sockets of hexagon socket head cap screws may respectively have different sizes. In other words, each type of hexagon socket head cap screws has its own dedicated fastening element 14. Thus, the user cannot use a hexagon socket head cap screw as the mandrel unless he has the dedicated fastening element 14 thereof.

Accordingly, the present invention proposes a riveting device to overcome the abovementioned problems.

SUMMARY OF THE INVENTION

The primary objective of the present invention is to provide a riveting device, which uses a push rod, a hold ring and an outer guide sleeve to secure a screw, and which can operate irrespective of the size or shape of the screw head.

To achieve the abovementioned objective, the present invention proposes a riveting device, which comprises an inner guide sleeve, an outer guide sleeve, a hold ring and a driver. The inner guide sleeve has a first space and a second space interconnecting with the first space. The first space surrounds a portion of the second space. A push rod is insertedly installed in the first space and the second space. The inner rim of one end of the outer guide sleeve has a first surface. The other end of the outer guide sleeve is disposed in the first space, surrounding a portion of the second space and sleeving the inner guide sleeve. The hold ring has a second surface and a third surface opposite the second surface. The hold ring is disposed inside the outer guide sleeve, and the second surface thereof is pressed against the first surface tightly. A screw is insertedly installed in the hold ring and the outer guide sleeve. The screw body of the screw is protrudent from the outer guide sleeve and then screwed into a rivet nut. The screw head of the screw is disposed in the first space and tightly pressed against the third surface by the push rod. Thereby, the screw is secured by the push rod, the hold ring and the outer guide sleeve. The driver is combined with the inner guide sleeve and drives the inner guide sleeve, the push rod, the outer guide sleeve, the hold ring, the screw and the rivet nut to move jointly and rivet the rivet nut.

Below, embodiments are described in detail in cooperation with the attached drawings to make easily understood the technical contents, characteristics, and accomplishments of the present invention.

DETAILED DESCRIPTION OF THE INVENTION

Figure 1:
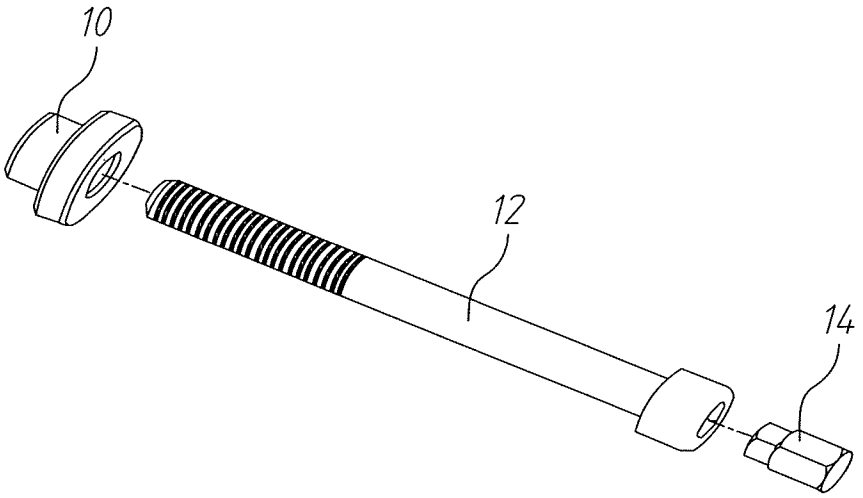
Fig. 1 Prior Art
FIG. 1 is an exploded view schematically showing a screw, a guide sleeve and a fastening element of a conventional technology.
Figure 2:
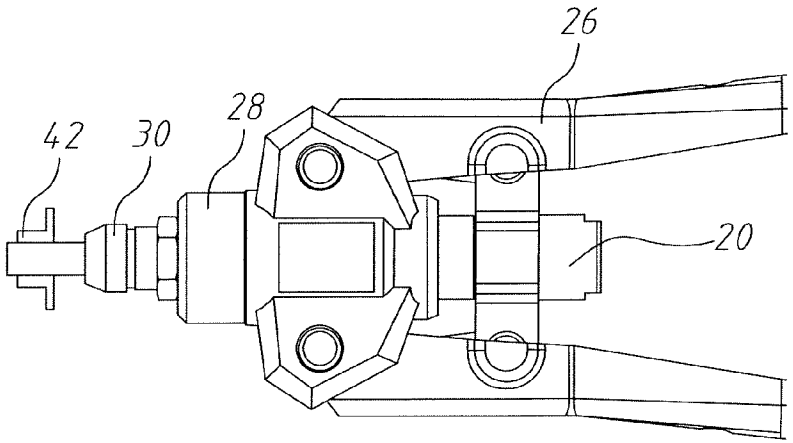
FIG. 2 is a perspective view schematically showing a riveting device according to one embodiment of the present invention.
Figure 3:
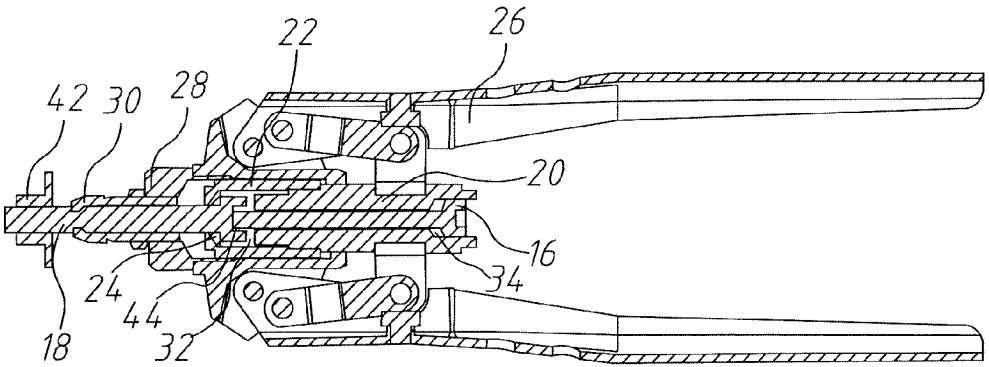
FIG. 3 is a sectional view schematically showing a riveting device according to one embodiment of the present invention.
Figure 4:
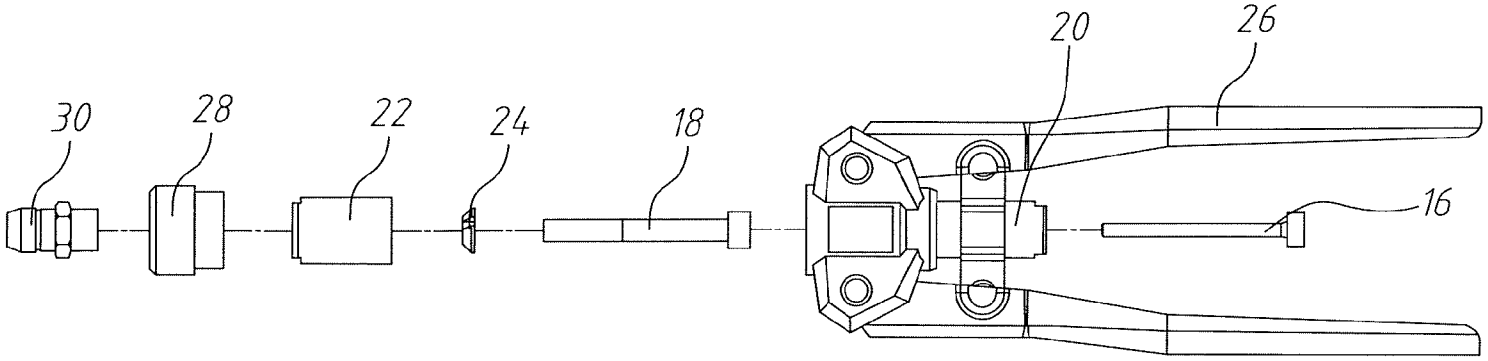
FIG. 4 is an exploded perspective view schematically showing a riveting device according to one embodiment of the present invention.
Figure 5:
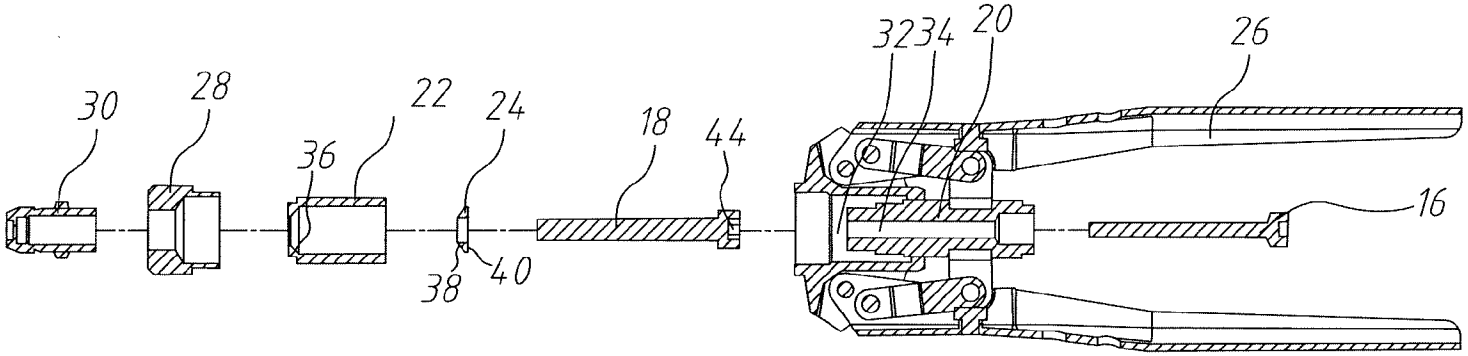
FIG. 5 is an exploded sectional view schematically showing a riveting device according to one embodiment of the present invention.
Figure 7:
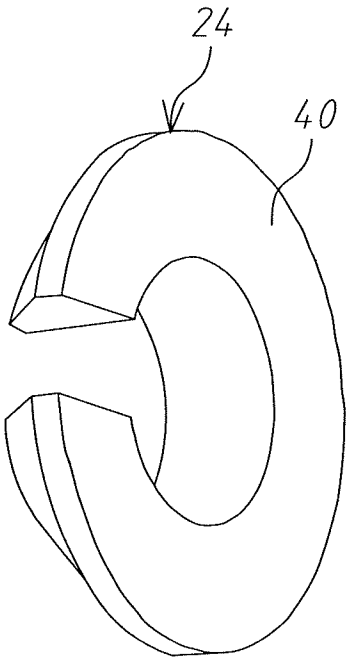
FIG. 7 is a rear perspective view schematically showing a conical ring according to one embodiment of the present invention.
Figure 6:
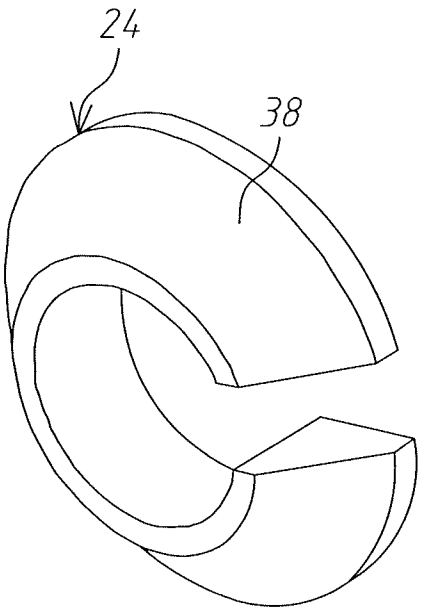
FIG. 6 is a front perspective view schematically showing a conical ring according to one embodiment of the present invention.

Refer to FIGS. 2-7. The riveting device of the present invention comprises a push rod 16, a screw 18, an inner guide sleeve 20, an outer guide sleeve 22, a hold ring 24, a driver 26, an outer protection tube 28 and an inner protection tube 30. The push rod 16 is a metallic push rod. The screw 18 is a metallic screw functioning as a mandrel. The present invention does not particularly limit the shape of the screw 18. The inner guide sleeve 20 is a metallic inner guide sleeve. The outer guide sleeve 22 is a metallic outer guide sleeve. The hold ring 24 is a metallic hold ring. In this embodiment, the driver 26 is exemplified by a manual driver, such as a pair of manually-driven handlebars. The driver 26 is combined with the inner guide sleeve 20. The inner guide sleeve 20 has a first space 32 and a second space 34 interconnecting with the first space 32. The first space 32 surrounds a portion of the second space 34. The side wall of the head of the push rod 16 has a first thread. The side wall of the second space 34 has a second thread. The push rod 16 is screwed into the inner guide sleeve 20 via the first thread and the second thread and insertedly installed in the first space 32 and the second space 34.

The inner rim of one end of the outer guide sleeve 22 has a first surface 36. The other end of the outer guide sleeve 22 is disposed inside the first space 32, encircling a portion of the second space 34 and sleeving the inner guide sleeve 20. The hold ring 24 has a second surface 38 and a third surface 40 opposite the second surface 38. The hold ring 24 is disposed inside the outer guide sleeve 22 with the second surface 38 thereof tightly pressed against the first surface 36 of the outer guide sleeve 22. The hold ring 24 and the end of the outer guide sleeve 22, which the hold ring 24 is tightly pressed against, are arranged inside the first space 32. The screw 18 is inserted into the hold ring 24 and the outer guide sleeve 22. The screw body of the screw 18 protrudes from the outer guide sleeve 22, screwingly engaged with a rivet nut 42. The screw head of the screw 18 is disposed inside the first space 32, tightly pressed against the third surface 40 by the push rod 16. The top surface of the screw head has a recess 44. The push rod 16 is inserted into the recess 44 and tightly pressed against the screw head. Thus, the screw 18 is secured by the push rod 16, the hold ring 24 and the outer guide sleeve 22. In order to effectively prevent the screw 18 from independently rotating, the hold ring 24 is designed to be a conical ring. However, the present invention does not particularly limit the shape of the hold ring 24. In this embodiment, the first surface 36 is a first conical surface gradually shrinking from the interior of the outer guide sleeve 22 to the exterior of the outer guide sleeve 22; the second surface 38 is a second conical surface corresponding to the first conical surface; the third surface 40 is a planar surface. While the push rod 16 is screwed into the inner guide sleeve 22 via the first thread and the second thread, the push rod 16 pushes the screw 18 forward. During pushing, the second conical surface, which is pushed toward the first conical surface, contracts, and the elasticity of the metallic hold ring pushes the screw 18 backward at the same time. The hold ring 24 functions like a collet herein. Thus, while the screw 18 is pushed forward, the hold ring 24 will grip the screw 18 tightly. Via the mutual pushing and the friction between metals, the push rod 16, the screw 18, the inner guide sleeve 20, the outer guide sleeve 22, and the holding ring 24 operate jointly like a single component. As the present inventions uses the push rod 16, the outer guide sleeve 22 and the hold ring 24 to secure the screw 18, the operation of the present invention is not influenced by the shape or size of the recess 44 of the screw head of the screw 18. Therefore, the riveting device of the present invention can use various types of screws respectively having different screw heads. The driver 26 uses the inner guide sleeve 20 to drive the push rod 16, the outer guide sleeve 22, the hold ring 24 and the screw 18 to move back and forth so as to fasten the rivet nut 42.

The outer protection tube 28 is disposed in the first space 32, sleeving the outer guide sleeve 22 and located between the outer guide sleeve 22 and the inner guide sleeve 20. The screw body of the screw 18 penetrates the outer protection tube 28 and protrudes from the outer protection tube 28. A portion of the inner protection 30 is sleeved by the inner wall of the outer protection tube 28. The screw body of the screw 18 penetrates the inner protection tube 30 and protrudes from the inner protection tube 30. Then, the screw body of the screw 18 is screwed into the rivet nut 42.

In one embodiment, the top surface of the screw head of the screw 18 is planar and free of a recess. In the present invention, the push rod 16 tightly presses against the top surface of the screw head, and the screw 18 is secured by the push rod 16, the hold ring 24 and the outer guide sleeve 22. Therefore, the riveting device of the present invention can operate irrespective of the appearance of the screw head.

Figure 8:
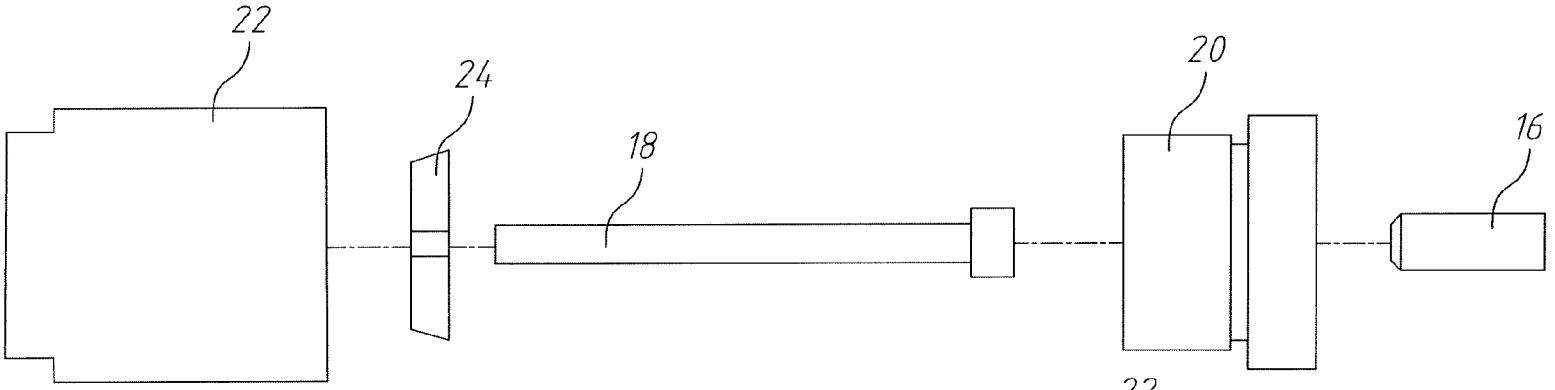
FIG. 8 is an exploded side view schematically showing an inner guide sleeve, an outer guide sleeve, a screw and a push rod according to one embodiment of the present invention.
Figure 9:
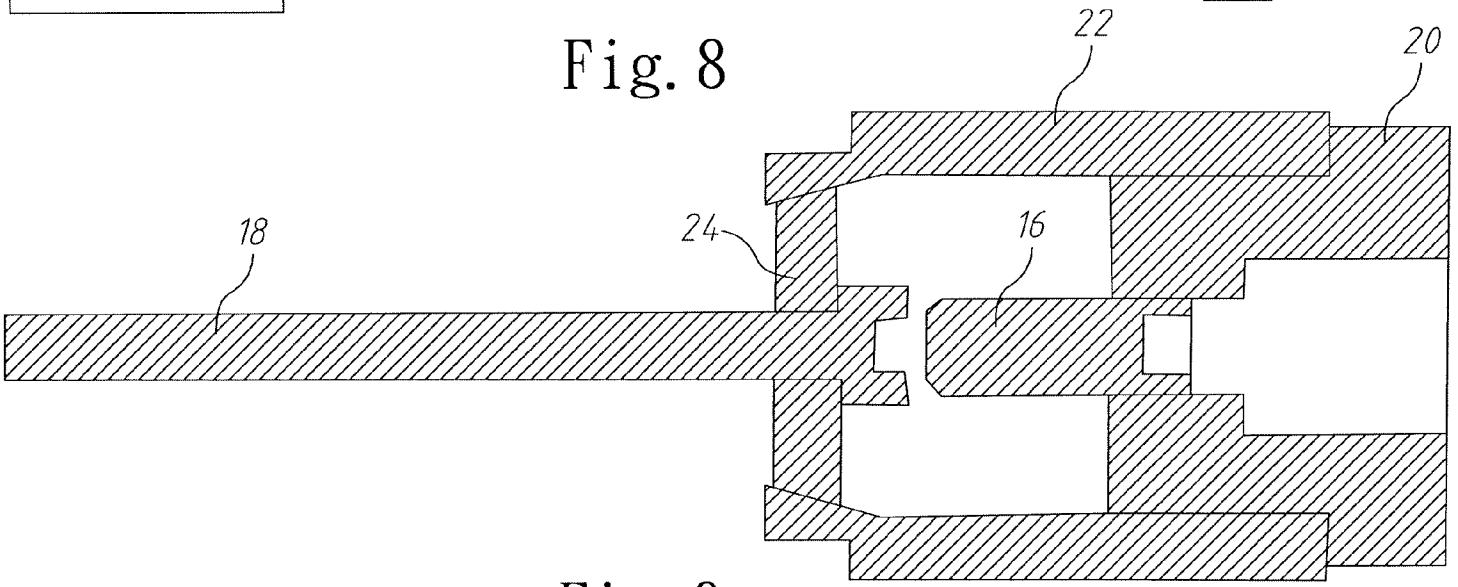
FIG. 9 is a sectional view schematically showing an inner guide sleeve, an outer guide sleeve, a screw and a push rod according to one embodiment of the present invention.

In the present invention, the driver 26 is realized with a manual driver, a hydraulic driver, an electric driver or a pneumatic driver. Refer to FIG. 8 and FIG. 9 diagrams schematically showing that the push rod 16, the screw 18, the inner guide sleeve 20, the outer guide sleeve 22 and the hold ring 24 are installed on a pneumatic driver, wherein the inner guide sleeve 20 is detachably combined with the pneumatic driver. Therefore, the inner guide sleeve 20 and the push rod 16 are replaceable.

In conclusion, the present invention is characterized in using the inner guide sleeve 20, the hold ring 24 and the push rod 16 to secure the screw 18 and exemption from the limitation of the shape of the screw head.

What is claimed is:

1. A riveting device comprising an inner guide sleeve having a first space and a second space interconnecting with the first space, wherein said first space surrounds a portion of said second space, and wherein a push rod is inserted into said first space and said second space;

an outer guide sleeve, wherein an inner rim of one end of said outer guide sleeve has a first surface, and wherein another end of said outer guide sleeve is disposed in said first space, surrounds a portion of said second space, and sleeves said inner guide sleeve;

a hold ring having a second surface and a third surface opposite said second surface, and disposed inside said outer guide sleeve, wherein said second surface is pressed against said first surface tightly, and wherein a screw is inserted through said outer guide sleeve and said hold ring, and wherein a screw body of said screw is protrudent from said outer guide sleeve and then screwed into a rivet nut, and wherein a screw head of said screw is disposed in said first space and tightly pressed against said third surface by said push rod, and wherein said screw is secured by said push rod, said hold ring and said outer guide sleeve; and a driver combined with said inner guide sleeve, driving said inner guide sleeve, said push rod, said outer guide sleeve, said hold ring, said screw and said rivet nut to move jointly to fasten said rivet nut.

2. The riveting device according to claim 1, wherein said hold ring, and said end of said outer guide sleeve, which is tightly pressed against said hold ring, are disposed in said first space.

3. The riveting device according to claim 2 further comprising an outer protection tube, wherein a portion of said outer protection tube is disposed in said first space to sleeve said outer guide sleeve and located between said outer guide sleeve and said inner guide sleeve, and wherein said screw body of said screw is inserted through said outer protection tube to protrude from said outer protection tube and then screwed into said rivet nut.

4. The riveting device according to claim 3 further comprising an inner protection tube, wherein an inner wall of said outer protection tube sleeves a portion of said inner protection tube, and wherein said screw body of said screw is inserted through said inner protection tube to protrude from said inner protection tube and then screwed into said rivet nut.

5. The riveting device according to claim 1, wherein a side wall of said push rod has a first thread, and wherein a side wall of said second space has a second thread, and wherein said push rod is screwed into said inner guide sleeve via said first thread and said second thread and then insertedly installed in said first space and said second space.

6. The riveting device according to claim 5, wherein said first thread is formed on said side wall of a rod head of said push rod.

7. The riveting device according to claim 1, wherein a top surface of said screw head of said screw has a recess, and wherein said push rod is inserted into said recess and pressed against said screw head tightly.

8. The riveting device according to claim 1, wherein said hold ring is a conical ring, and wherein said first surface is a first conical surface gradually shrinking from interior of said outer guide sleeve to exterior of said outer guide sleeve, and wherein said second surface is a second conical surface corresponding to said first conical surface, and wherein said third surface is a planar surface.

9. The riveting device according to claim 1, wherein said outer guide sleeve comprises a metallic material.

10. The riveting device according to claim 1, wherein said inner guide sleeve, said push rod and said screw are respectively comprise metallic materials.

11. The riveting device according to claim 1, wherein said driver is a manual driver, an electric driver, a hydraulic driver, or a pneumatic driver.

12. The riveting device according to claim 11, wherein said driver is a pair of manually-driven handlebars.

* * * * *